United States Patent [19]

Busse

[11] 4,366,961

[45] Jan. 4, 1983

[54] METHOD AND APPARATUS FOR CONSTRUCTING PYRAMID

[76] Inventor: William E. Busse, Box 1121, Oracle, Ariz. 85623

[21] Appl. No.: 278,835

[22] Filed: Jun. 29, 1981

[51] Int. Cl.[3] ..... A63H 33/16

[52] U.S. Cl. ..... 273/155; 46/1 L; 434/403; 493/959

[58] Field of Search ..... 46/1 L, 21; 273/155; 428/8, 9, 11; 434/403; 493/405, 458, 955, 959

[56] References Cited

U.S. PATENT DOCUMENTS

| | | | |
|---|---|---|---|
| 1,997,022 | 4/1935 | Stalker | 46/1 L |
| 2,164,966 | 7/1939 | Tutein | 46/21 UX |
| 2,633,657 | 4/1953 | Warren | 493/955 X |
| 2,883,195 | 4/1959 | Rogers | 273/155 |
| 3,785,066 | 1/1974 | Tuitt | 434/403 |
| 3,894,352 | 7/1975 | Hooker | 493/405 X |
| 3,971,156 | 7/1976 | Lamlee | 46/1 L |

FOREIGN PATENT DOCUMENTS

| | | | |
|---|---|---|---|
| 9189 | of 1913 | United Kingdom | 46/1 L |

*Primary Examiner*—Harland S. Skogquist
*Attorney, Agent, or Firm*—Drummond, Nelson & Nissle

[57] ABSTRACT

Apparatus for constructing a pyramid. The apparatus comprises a circular piece of material having a circular front face; a circular back face; and a plurality of fold lines formed on at least one of the faces. The fold lines include diameter lines each traversing and passing through the center point of the circular face, and chord lines each shorter in length than the diameter lines, either end of the chord lines and the diameters lines coinciding with a point on the circumference of the face. The pyramid is formed by sequentially folding the circular piece of material along the fold lines.

1 Claim, 28 Drawing Figures

METHOD AND APPARATUS FOR CONSTRUCTING PYRAMID

This invention relates to apparatus and methods for constructing pyramids.

More particularly, the invention relates to a circular piece of material which can be sequentially folded along chord lines formed thereon to construct a pyramid.

In a further and more specific respect the invention concerns a method for manually constructing a pyramid having four equal sized faces from a plain piece of circular material having no chord lines formed on the surface thereof, the pyramid being constructed from the circular piece of material without the use of a straight-edge, rule, compass or any other auxiliary drawing, measuring, cutting or inscribing tool and without having to utilize adhesive or mechanical fasteners to secure sections of material to one another.

Modern day civilization has long held a fascination for pyramids, especially the three monumental pyramids of Giza, Egypt. The history of the Egyptian pyramids is routinely examined at some point during every individual's formal education. The pyramids are an excellent educational tool because their study cuts across numerous disciplines including geography, architecture, mechanical engineering, geodesy, history, metallurgical engineering, linguistics, astronomy, mathematics and civil engineering. In conjunction with such study pyramid models can be constructed from a sheet of material by utilizing a rule and marking instrument to lay out triangles on the material which can be cut out and fastened together to form a pyramid. However, little knowledge is gained from such an exercise, which is generally limited in use to grade school classrooms, and neither the imagination, intellect or manual manipulative skill of an individual are challenged by this type of "cut and paste" procedure. Instead, learning is often better assisted by making the construction of a required object an analytical problem which, while being absorbing and interesting, taxes the ingenuity of an individual. Thus, if the construction of a pyramid model were something of a puzzle, assimilation of the geometric relationships existent in the pyramid would probably be enhanced. The use of pyramid models would also be facilitated if such models could be made without having to utilize measuring, inscribing or cutting instruments or having to use adhesive or mechanical fasteners to form the pyramid.

Accordingly, it would be highly desirable to provide an improved apparatus and method for constructing a pyramid which would not require auxiliary cutting, engraving or fastening tools and which would tax the ingenuity and maintain the interest of an individual using the apparatus.

Therefore, a principal object of the present invention is to provide improved apparatus and method for constructing a pyramid.

Another object of the invention is to provide apparatus which can be used to form a pyramid without having to also employ auxiliary fastening, severing or marking tools and materials.

A further object of the invention is to provide improved apparatus for constructing a pyramid which requires analytical intellectual effort on the part of the user of the apparatus.

Still another object of the invention is to provide a method of forming a pyramid from a single piece of circular material having no lines or markings formed thereon to indicate how the pyramid is constructed therefrom, the pyramid being constructed from the piece of material without the use of any marking tools or materials.

These and other, further and more specific objects and advantages of the invention will be apparent to those skilled in the art from the following detailed description thereof, taken in conjunction with the drawings, in which.

Figure 1:
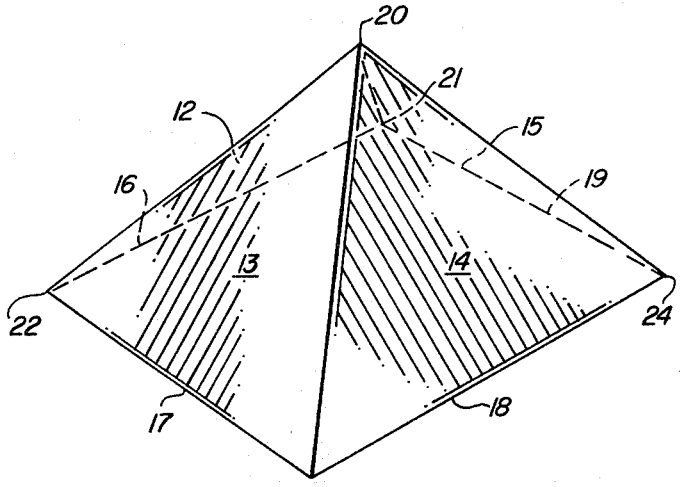
FIG. 1 is a perspective view of a pyramid constructed in accordance with the invention.
Figure 3A:
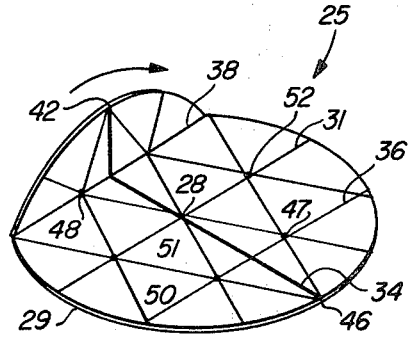
FIG. 3A is a perspective view of the circular sheet of material of FIG. 2 illustrating the first sequential step of folding the material along fold lines formed therein to construct a pyramid in accordance with the invention.
Figure 3B:
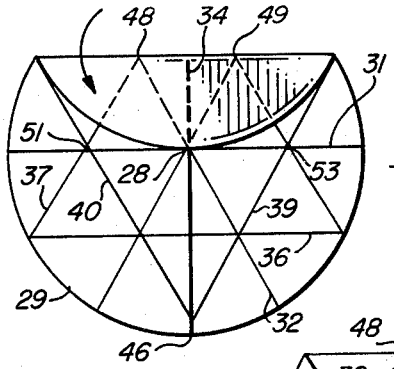
FIG. 3B is a top view of the sheet of material of FIG. 3A.

Briefly, in accordance with one embodiment of my invention, I provide apparatus for constructing a pyramid. The apparatus comprises a circular piece of material having a circular front face; a circular back face; and a plurality of fold lines formed on at least one of the faces, the fold lines including diameter lines each traversing and passing through the center point of the circular face and including chord lines each shorter in length than said diameter lines. Either end of each chord line and the diameter line coincides with a point on the circumference of the face of the material. The pyramid is formed by sequentially folding the circular piece of material along the fold lines.

The fold lines may include six chord lines defining a first and second equilateral triangle, the apexes of each triangle lying along the circumference of the piece of material and each side of the first triangle being parallel to one side of the second triangle; three diameter lines each passing through a pair of the points at which the chord lines forming the equilateral triangles intersect; and, a fourth diameter line intersecting a pair of the apexes of the equilateral triangles at the circumference of the circular face of the material.

In another embodiment of my invention, I provide a method for forming a pyramid having four triangular faces of equal area. The method comprises the steps of forming fold lines on a circular piece of material having a circular front surface and a circular back surface, and sequentially folding the piece of material along the fold lines to form a pyramid. The fold lines are formed on at least one of the circular surfaces and include six chord lines defining a first and a second equilateral triangle, the apexes of each of the triangles lying along the circumference of the circular face and each side of the first triangle being parallel to one side of the second triangle; three diameter lines each traversing and passing through the center point of the circular surface and through a pair of the points at which said chord lines forming said triangles intersect; and a fourth diameter line traversing and passing through the center point of the circular surface and intersecting a pair of the apexes of the triangles at the circumference of the surface. The fold lines define a plurality of secondary equilateral triangles smaller than said first and second equilateral triangles including a group of six secondary equilateral triangles including a group of six secondary equilateral triangles of equal size forming a hexagon in the center of the circular surface, one apex of each of said six secondary triangles lying at the center point of the circular surface and a mirror image pair of the six triangles being bisected by the fourth diameter line, the remaining four of said six triangles being free of fold lines traversing the area thereof. The pyramid formed by folding the circular piece of material has four faces each corresponding to one of said four secondary triangles free of fold lines traversing the area thereof.

Turning now to the drawings, which depict the presently preferred embodiments of the invention for the purpose of illustrating the practice thereof and not by way of limitation of the scope of the invention, and in which like reference characters correspond to identical elements throughout the several views, FIG. 1 illustrates a pyramid, generally indicated by reference character 11, formed by folding a circular piece of material in accordance with the invention. Pyramid 11 includes apex 20; faces 12, 13, 14, 15 each having respective base line 16, 17, 18, 19; and corner points 21, 22, 23, 24. Pyramid 11 is formed by folding a circular piece of material, generally indicated by reference character 25 in FIGS. 2–12, along fold lines shown in FIG. 2J. Although the fold lines illustrated in FIG. 2J may be inscribed on material 25, I am able to form the fold lines by sequentially manually creasing circular sheet 25. As can be appreciated by FIGS. 2A–2J, creasing of sheet 25 to form the various fold lines needed to practice the presently preferred embodiments of the invention can be accomplished without the utilization of any auxiliary marking or measuring tools. Material 25 has an upper circular face or surface 26 and a lower or back circular face 27. In FIGS. 2A–2J circular sheet 25 is presumed to be supported by a flat surface so that back face 27 of sheet 25 is not visible.

The fold lines which are necessary to allow formation of pyramid 11 from circular sheet of material 25 include chord lines and diameter lines. The diameter lines each traverse and pass through the center of upper face 26 while the chord lines are shorter than diameter lines and do not intersect the center point 28 of circular sheet 25. Either end of each chord line and diameter line coincides with a point on the circumference 29 of circular sheet 25. As illustrated in FIGS. 2A–2J the fold lines utilized in the presently preferred embodiments of the invention include three minor diameter lines 31, 32, 33; a fourth diameter line 34 termed the major diameter line; and six chord lines 35, 36, 37, 38, 39, 40. FIGS. 2H and 2J show that chord lines 35, 36, 37 form a first primary equilateral triangle having apexes 41, 42, 43 coinciding with points on the circumference 29 of piece 25. Chord lines 38, 39, 40 form a second primary equilateral triangle having apexes 44, 45, 46 coinciding with points on the circumference 29 of circular sheet 25. Each side of the first primary triangle is parallel to one side of the second primary triangle. For instance, chord line 37 is parallel to chord line 39. Each minor diameter line, in addition to passing through center point 28, intersects a pair of points at which two of chord lines 35–40 intersect. Accordingly, in FIG. 2J minor diameter line 31 intersects points 51, 52; line 32 intersects points 47, 48; and, line 33 intersects points 49, 50. Portions of chord lines 35–40 and of minor diameter lines 31–33 define a hexagon consisting of six secondary equilateral triangles in the center of the upper surface 26 of circular sheet 25. Points 47–52 are all positioned on the peripheral edge of the hexagon, while center point 28 of sheet 25 is also the center point of the hexagon. The peripheral edge of the hexagon is comprised of a portion of each of six chord lines 35–40. Portions of the length of each of the minor diameter lines 31–33 divide the hexagon into six equal sized secondary equilateral triangles which are smaller in size than the first and second primary equilateral triangles. One of the apexes of each of the six secondary equilateral triangles coincides with center point 28 of circular sheet 25. Major diameter line 34 bisects a mirror pair of the six secondary equilateral triangles and, as is illustrated in FIG. 2J, intersects apexes 42, 46 of the first and secondary primary equilateral triangles. The remaining four of the six secondary equilateral triangles have no fold lines or creases traversing the area within their perimeters. When circular sheet 25 is folded to construct a pyramid 11, center point 28 corresponds to apex 20 of constructed pyramid 11; points 51 and 52 correspond to two of the corner points 21–24 of pyramid 11; points 47, 50 correspond to another of corner points 21–24; points 48, 49 correspond to yet another of corner points 21–24; the four secondary equilateral triangles having no fold lines traversing the area within their perimeters each correspond to one of the faces 12–15 of pyramid 11; and, the lines connecting points 47, 52, points 52, 49, points 48, 51 and points 51, 50 correspond to lines 16–19 forming the periphery of the base of pyramid 11.

The presently preferred method of folding creased circular piece 25 of FIG. 2J to construct pyramid 11 is depicted in FIGS. 3–12. The first sequential step is to, as shown in FIGS. 3A and 3B, fold sheet 25 along chord line 38. In the second sequential step, depicted in FIGS. 4A–4C, circular piece 25 is folded along chord line 36. When the first and second folding steps are completed, material 25 is, as seen in FIG. 4B, substantially flat. During the third sequential folding step illustrated in FIGS. 5A–5C, the folded material of FIG. 4B is folded along major diameter line 34 and diameter lines 31, 32, 33 to form the cupped shape of FIG. 5C. During the fourth folding step, the triangular pair of ears seen in FIG. 5C are, as shown by arrows A, folded along diameter lines 32, 33 and against the interior walls of the cupped member of FIG. 5C. After completion of the fourth folding step the cup member of FIG. 5C appears as shown in FIGS. 6A and 6B. During the fifth sequential folding step corners 45, 41 of the piece of material of FIGS. 6A, 6B are, as shown by arrow B, folded downwardly along chord lines 39, 40 into the interior space of the cupped member to coincide with point 28. After completion of the fifth folding step the material 25 appears as shown in FIGS. 7A–7C. During the final folding step corner points 43, 44 are, as shown by arrows C in FIGS. 7B, 7C, folded downwardly and inwardly to coincide with point 28. After completion of the final folding step a pyramid has been constructed as shown in FIGS. 8A and 8B.

Figure 4A:
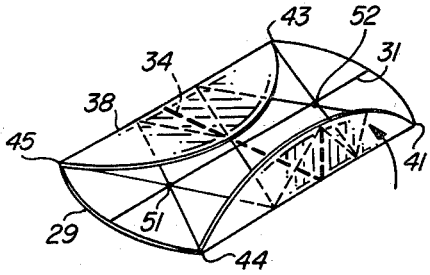
FIG. 4A is a perspective view of the sheet of material of FIG. 3B depicting the second sequential step of folding the circular material along fold lines formed therein to construct a pyramid in accordance with the invention.
Figure 4B:
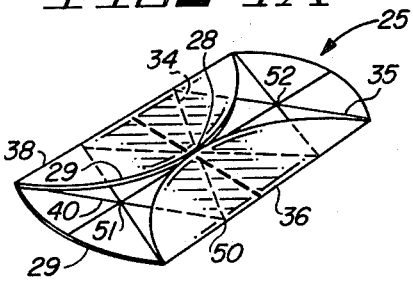
FIG. 4B is a perspective view illustrating the sheet of material of FIG. 4A after completion of the second sequential folding step.
Figure 4C:
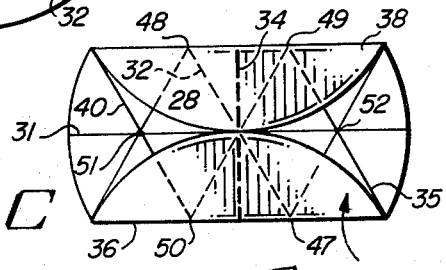
FIG. 4C is a top view of the sheet of material of FIG. 4B.
Figure 5B:
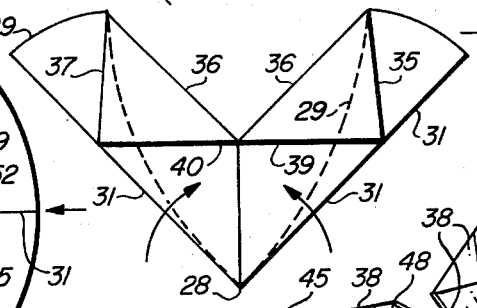
FIG. 5B is a side view of the piece of material of FIG. 5A.
Figure 5A:
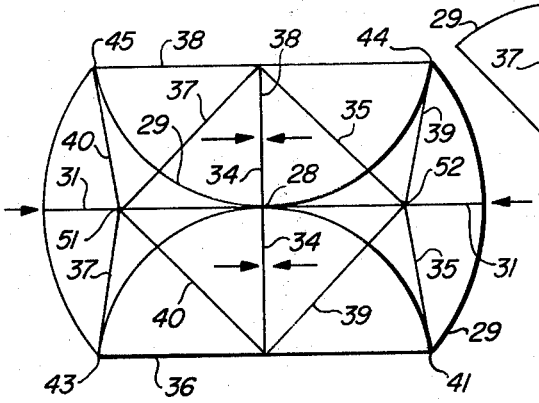
FIG. 5A is a top view of the piece of material of FIG. 4C after it has been further folded during the third sequential step of folding.
Figure 5C:
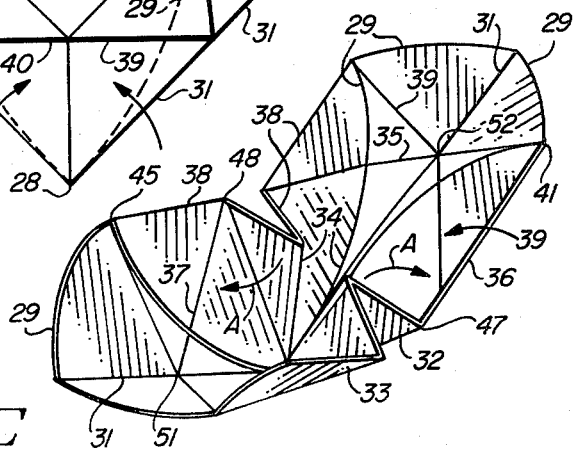
FIG. 5C is a perspective of the piece of material of FIG. 4C illustrating the folding thereof during the third sequential step of folding.
Figure 2:
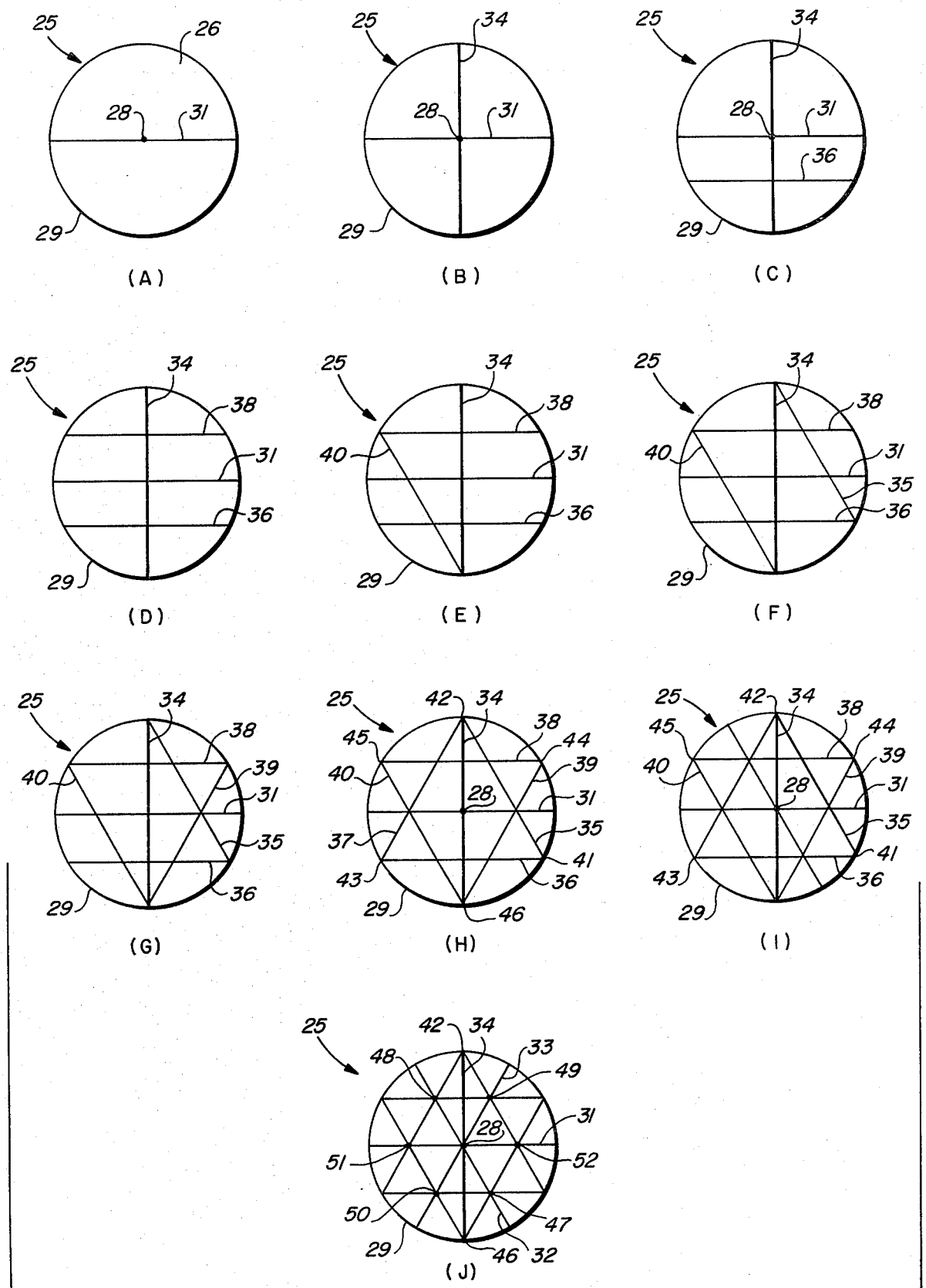
FIG. 2 is a series of top views of a circular sheet of material illustrating how fold lines can be formed therein by sequentially creasing the material.
Figure 6A:
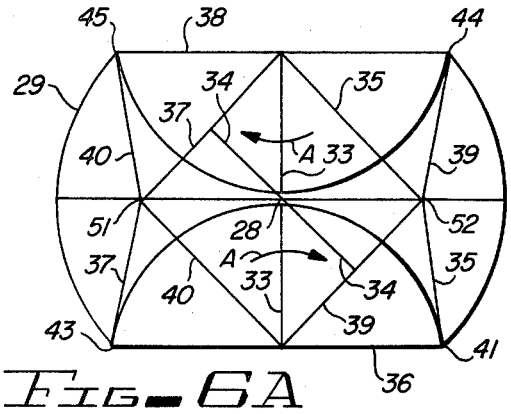
FIG. 6A is a top view of the material of FIG. 5A after it has been further folded during the fourth sequential step of folding the circular sheet of FIG. 2J to construct a pyramid.
Figure 6B:
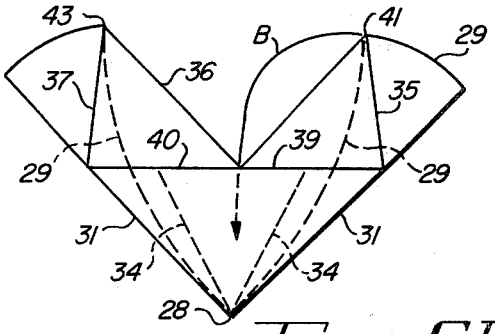
FIG. 6B is a side view illustrating the piece of material of FIG. 5B after completion of the fourth folding step.
Figure 7A:
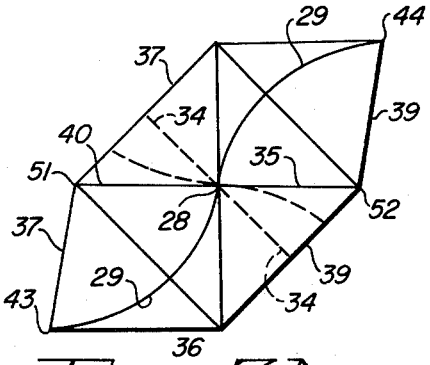
FIG. 7A is a top view of the material of FIG. 6A after it has been further folded during the fifth sequential step of folding the circular sheet of FIG. 2J to construct a pyramid.
Figure 7B:
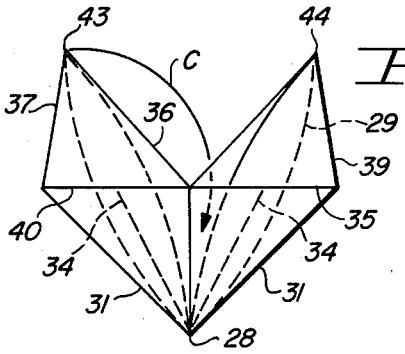
FIG. 7B is a front elevation view of the sheet of material of FIG. 7 further illustrating the material of FIGS. 6A and 6B after completion of the fifth sequential step of folding.
Figure 7C:
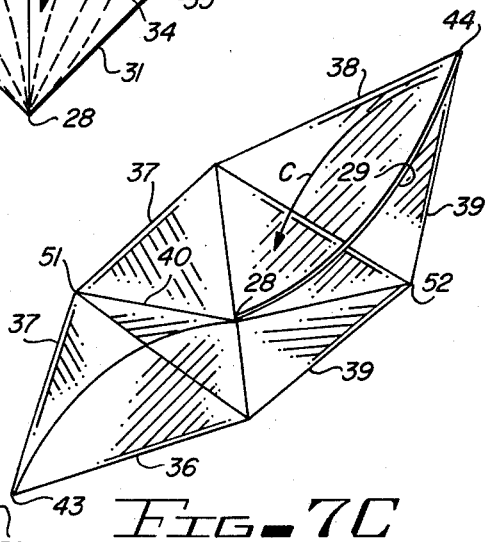
FIG. 7C is a top perspective view of the material of FIGS. 7A and 7B.
Figure 8A:
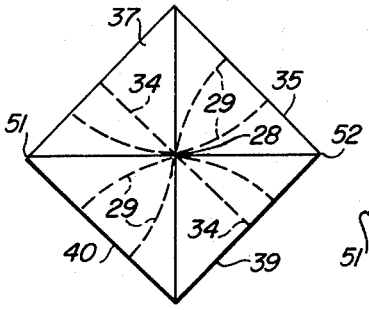
FIG. 8A is a top view of the material of FIG. 7A after it has been further folded during the final sequential step of folding the piece of material of FIG. 2J.
Figure 8B:
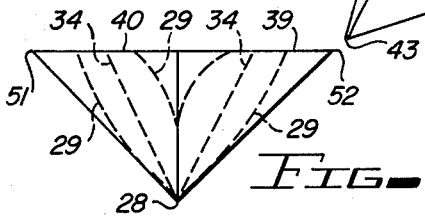
FIG. 8B is a front elevation view of the material of FIG. 8A.
Figure 9A:
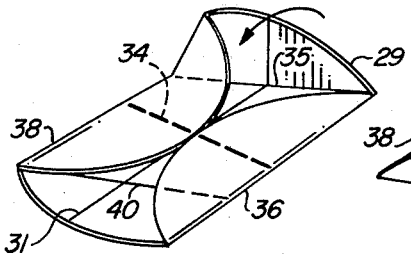
FIG. 9A is a perspective view of the piece of material of FIG. 4C showing in part an alternate third sequential step of folding the circular sheet of material along fold lines formed therein to form a pyramid.
Figure 9B:
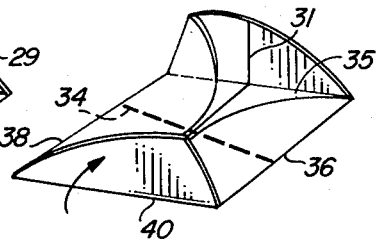
FIG. 9B is a perspective view of the piece of material of FIG. 9A further illustrating the folding thereof during the third sequential step of the folding.
Figure 9C:
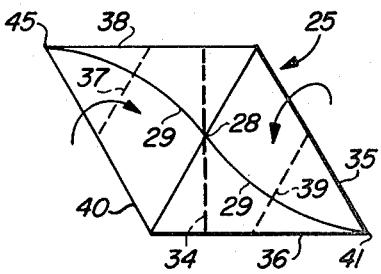
FIG. 9C is a top view showing the piece of material of FIG. 4C after completion of the alternative third folding step.
Figure 10:
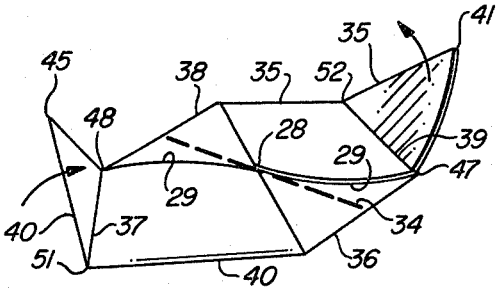
FIG. 10 is a perspective view of the material of FIG. 9C illustrating the folding thereof during the fourth sequential step of folding the circular sheet of FIG. 2J to construct a pyramid.
Figure 11:
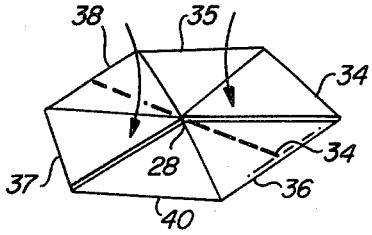
FIG. 11 is a perspective view illustrating the piece of material of FIG. 9C after completion of the fourth folding step.
Figure 12:
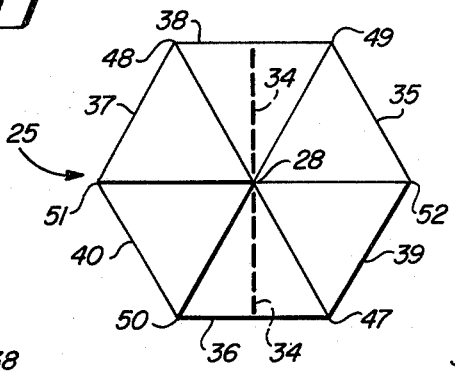
FIG. 12 is a top view of the folded sheet of material of FIG. 11.
Figure 13:
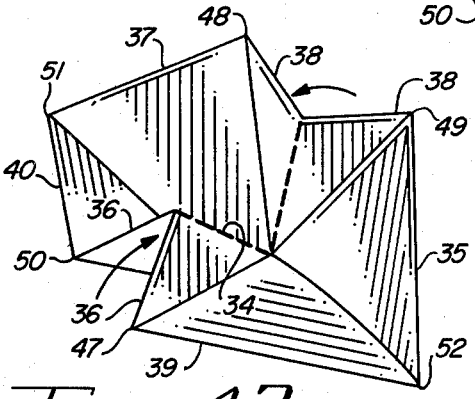
FIG. 13 is a top perspective view of the sheet of material of FIG. 12 illustrating the folding thereof during the fifth sequential step of folding the circular sheet of material of FIG. 2J.
Figure 14:
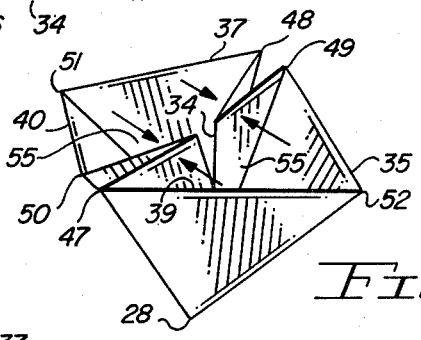
FIG. 14 is a top perspective view of the material of FIG. 13 illustrating the completion of the fifth sequential step of folding the piece of material of FIG. 2J.
Figure 15:
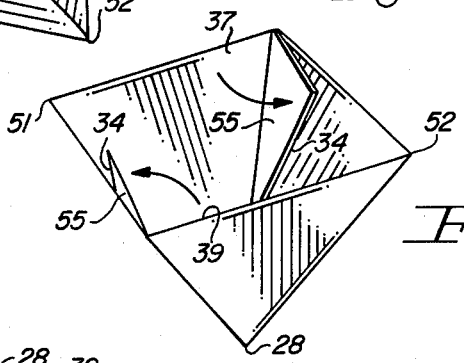
FIG. 15 is a perspective view of the material of FIG. 14 illustrating the final sequential step in folding the circular piece of material of FIG. 2J to form a pyramid.
Figure 16:
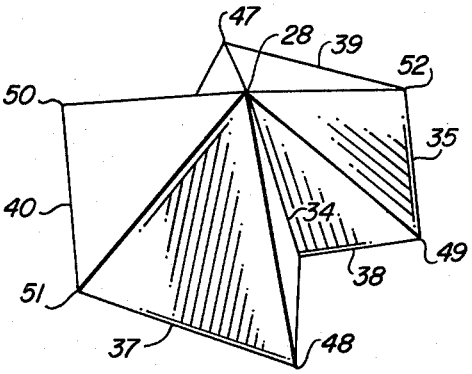
FIG. 16 is a bottom perspective view of the piece of material depicted in FIG. 13.
Figure 17:
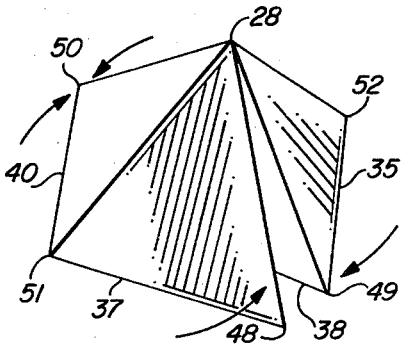
FIG. 17 is a bottom perspective view of the piece of material shown in FIG. 14.

In an alternate method of folding creased circular piece 25 of FIG. 2J to construct pyramid 11 the first and second sequential steps shown in FIGS. 3A, 3B and FIGS. 4A, 4B and 4C are repeated. Then during an alternate third sequential folding step, illustrated in FIGS. 9A–9C, the folded material of FIG. 4B is folded along chord lines 40 and 35 to form the parallelogram of FIG. 9C. The folded product of FIG. 9C is again substantially flat. In the fourth alternate folding step, seen in FIGS. 10 and 11, the folded material 25 of FIG. 9C is folded along chord lines 37, 39. When the fourth sequential folding step is completed, folded material 25 is, as shown in FIG. 12, again substantially flat. To perform the fifth alternate folding step, shown in FIGS. 13, 14, chord lines 36, 38 are, while maintaining center point 28 in contact with a flat support surface, upwardly and inwardly lifted so that the triangles defined by apex points 48, 49, 28 and points 47, 50, 28 bend along bisecting major diameter line 24 to form triangular flaps 55. In the sixth and final folding step depicted in FIG. 15, flaps 55 are rotated against a pair of the inner walls of pyramid 11. FIGS. 16 and 17 are bottom views of the fifth folding step seen in FIGS. 13 and 14, respectively.

In the presently preferred folding procedures described above, I have found that in order for the circular sheet 25 shown in FIG. 2J to be folded into pyramid 11 without the creation of additional fold lines, sheet 25 should, during the first and second sequential folding steps illustrated in FIGS. 3 and 4, be folded along a pair of chord lines which are perpendicular to major diameter line 34, i.e., along chord lines 36, 38. It is also important to realize that the mirror pair of secondary equilateral triangles bisected by major diameter line 34 must eventually be folded along line 34 as seen in FIGS. 8, 9, and to realize that center point 28 will, when folding is completed, correspond to the apex 20 of pyramid 11. In addition, regardless of variation in the sequence of folding steps or in folds made, when the pyramid 11 has been constructed, the four secondary equilateral triangles which are free of fold lines traversing their areas (See FIG. 2J) will correspond to faces 12–15 of pyramid 11.

It is anticipated that the invention will be presented as an analytical exercise or game which will, depending on the amount of auxiliary information provided, have various levels of difficulty. The most difficult form of the game would be to simply provide a circular piece of material with the information that if a proper combination of chord lines and diameter lines is formed on the piece of material then the material can be folded into a pyramid. The exercise would be progressively simplified by providing the number of each type line, the length of each line, the position of each line, the portions of pyramid 11 which specific parts of the pattern shown on piece 25 in FIG. 2J would correspond to, and finally, by providing information as to specific folding steps required to form pyramid 11 from the circular piece of material 25 illustrated in FIG. 2J.

Having described my invention in such terms as to enable those skilled in the art to understand and practice it, and having identified the presently preferred embodiments thereof,

I claim:

1. A method for forming a pyramid having four triangular faces of equal area, comprising the steps of (a) forming fold lines on a circular piece of material having a circular front surface and a circular back surface, said fold lines being formed on at least one of said surfaces and including (i) six chord lines defining a first and a second equilateral triangle, the apexes of each of said triangles lying along the circumference of said circular face and each side of said first triangle being parallel to one side of said second triangle, (ii) three diameter lines each traversing and passing through the center point of said surface and through a pair of the points at which said chord lines forming said triangles intersect, and (iii) a fourth diameter line traversing and passing through said center point of said surface and intersecting a pair of said apexes of said triangles at the circumference of said surface, said fold lines defining a plurality of secondary equilateral triangles on said surface smaller than said first and second equilateral triangles, including a group of six secondary equilateral triangles of equal size forming a hexagon in the center of said surface, one apex of each of said six triangles lying at the center point of said surface, and a mirror image pair of said six triangles being bisected by said fourth diameter line, the remaining four of said six triangles being free of fold lines traversing the area thereof, (b) sequentially folding said piece of material along said fold lines to form a pyramid, the four faces of said pyramid each corresponding to one of said four secondary triangles free of fold lines traversing the area thereof.

* * * * *